US012137736B1

(12) United States Patent
He

(10) Patent No.: US 12,137,736 B1
(45) Date of Patent: Nov. 12, 2024

(54) ELECTRONIC CIGARETTE HAVING A PLURALITY OF E-LIQUID STORAGE BINS

(71) Applicant: PAX Innovations (Shenzhen) Limited, Shenzhen (CN)

(72) Inventor: Wei He, Shenzhen (CN)

( * ) Notice: Subject to any disclaimer, the term of this patent is extended or adjusted under 35 U.S.C. 154(b) by 0 days.

(21) Appl. No.: 18/623,493

(22) Filed: Apr. 1, 2024

(30) Foreign Application Priority Data

Mar. 8, 2024 (CN) ..... 202420471044.1
Mar. 15, 2024 (CN) ..... 202420522859.8

(51) Int. Cl.

| | |
|---|---|
| ***A24F 40/30*** | (2020.01) |
| ***A24F 7/00*** | (2006.01) |
| ***A24F 40/10*** | (2020.01) |
| ***A24F 40/42*** | (2020.01) |
| ***A24F 40/44*** | (2020.01) |
| ***A24F 40/46*** | (2020.01) |
| ***A24F 40/48*** | (2020.01) |
| ***A24F 40/51*** | (2020.01) |
| ***A24F 40/90*** | (2020.01) |

(52) U.S. Cl.
CPC ..... *A24F 40/30* (2020.01); *A24F 7/00* (2013.01); *A24F 40/10* (2020.01); *A24F 40/42* (2020.01); *A24F 40/44* (2020.01); *A24F 40/46* (2020.01); *A24F 40/48* (2020.01); *A24F 40/51* (2020.01); *A24F 40/90* (2020.01)

(58) Field of Classification Search
CPC ..... A24F 40/30; A24F 40/10; A24F 40/40; A24F 40/48
See application file for complete search history.

(56) References Cited

U.S. PATENT DOCUMENTS

| | | | | |
|---|---|---|---|---|
| 9,936,737 | B2 * | 4/2018 | Cameron | A24F 40/40 |
| 10,212,971 | B2 * | 2/2019 | Cameron | A24F 40/05 |
| 2023/0263218 | A1 * | 8/2023 | Jang | A24F 40/42 |

FOREIGN PATENT DOCUMENTS

| | | | | |
|---|---|---|---|---|
| CN | 116326838 A | * | 6/2023 | |
| KR | 20220009837 A | * | 1/2022 | A24F 40/42 |
| WO | WO-2022211382 A1 | * | 10/2022 | A24B 15/167 |

* cited by examiner

*Primary Examiner* — Hae Moon Hyeon

(57) ABSTRACT

An electronic cigarette includes an electronic cigarette body and a plurality of e-liquid storage bins configured to store e-liquid. The electronic cigarette body is provided with a plurality of atomizing cores, and a mounting chamber is arranged on the electronic cigarette body. The mounting chamber is configured to mount the e-liquid storage bins. An e-liquid outlet configured to discharge the e-liquid is formed in each of the e-liquid storage bins. Each of the e-liquid storage bins is at least partially arranged in the mounting chamber. After the e-liquid storage bins are assembled into the mounting chamber, each of the atomizing cores is communicated to the e-liquid outlet of at least one e-liquid storage bin to add the e-liquid from the e-liquid storage bin into the atomizing core.

19 Claims, 8 Drawing Sheets

ELECTRONIC CIGARETTE HAVING A PLURALITY OF E-LIQUID STORAGE BINS

CROSS-REFERENCE TO RELATED APPLICATIONS

The application claims priorities of Chinese patent applications CN202420522859.8 and CN202420471044.1, filed on Mar. 15, 2024 and Mar. 8, 2024, which are incorporated herein by references in its entireties.

TECHNICAL FIELD

The present disclosure relates to the technical field of cigarette utensils, and in particular, to an electronic cigarette.

BACKGROUND

As is well known, when a disposable electronic cigarette leaves the factory, both its e-liquid capacity and battery capacity are fixed. After e-liquid or battery power is used up, the service life of the disposable electronic cigarette ends. However, generally, during configuration of the disposable electronic cigarette, the service time of power of the battery will be longer than the time it takes for the e-liquid to run out. The e-liquid cannot be supplemented, so that the number of times of smoking, which affects the service life of the disposable electronic cigarette. In addition, the existing disposable electronic cigarette generally only has one flavor and cannot achieve switching between multiple flavors, which cannot meet the needs of users.

SUMMARY

The present disclosure mainly aims to provide an electronic cigarette, which is used for solving the problems of a small number of times of smoking because e-liquid of an existing disposable electronic cigarette cannot be supplemented, and a single flavor.

In order to solve the technical problem, the technical scheme provided by the present disclosure is as follows.

An electronic cigarette includes an electronic cigarette body and a plurality of e-liquid storage bins configured to store e-liquid, wherein the electronic cigarette body is provided with a plurality of atomizing cores, and a mounting chamber is arranged on the electronic cigarette body;

the mounting chamber is configured to mount the e-liquid storage bins; an e-liquid outlet configured to discharge the e-liquid is formed in each of the e-liquid storage bins; each of the e-liquid storage bins is at least partially arranged in the mounting chamber; and after the e-liquid storage bins are assembled into the mounting chamber, each of the atomizing cores is communicated to the e-liquid outlet of at least one e-liquid storage bin to add the e-liquid from the e-liquid storage bin into the atomizing core.

Further, the electronic cigarette body includes a first top shell and a first outer shell connected to the first top shell to form a first accommodating chamber; the first top shell is detachably connected to the first outer shell; and the atomizing cores and the mounting chamber are both located in the first accommodating chamber.

Further, a bottom of the first top shell extends downwards from a position close to a peripheral side of the first top shell to form a first enclosure wall;

the first enclosure wall is arranged in the first accommodating chamber when the first top shell is connected to the first outer shell; and a first sealing ring is arranged between the first enclosure wall and a side wall of the first accommodating chamber.

Further, a first groove is formed in the first enclosure wall, and the first sealing ring is partially arranged inside the first groove;

a mouthpiece is arranged on the first top shell; a smoke outlet communicated to an atomizing core is formed in the mouthpiece; and a second sealing ring is arranged between the atomizing core and the first top shell.

Further, there are two atomizing cores which are arranged side by side in a width direction of the electronic cigarette body; there is one mouthpiece;

a bottom of the mouthpiece extends outwards to form a panel; the panel is rotatably arranged on the first top shell; and the smoke outlet is communicated to the other atomizing core when the panel rotates at a predetermined angle relative to the first top shell.

Further, the panel extends downwards to form a limiting column; a bottom of the limiting column extends outwards to form a limiting block; a gap penetrating through the limiting column is formed in the limiting column;

the first top shell is provided with a connection hole between two atomizing cores; the limiting column is arranged inside the connection hole; and an elastic member is arranged between the limiting block and the first top shell.

Further, the elastic member is a spring, and the spring sleeves the limiting column;

a second groove is formed in an upper surface of the first top shell; and the panel is arranged inside the second groove.

Further, the first top shell extends downwards from a peripheral side of the connection hole to form a second enclosure wall; and the elastic member is arranged in the second enclosure wall.

Further, the electronic cigarette body is internally provided with an e-liquid passing bin; at least one e-liquid passing chamber communicated to the atomizing cores is formed in the e-liquid passing bin;

one end of each of the e-liquid storage bins is provided with an insertion end, and the e-liquid outlet penetrates through the insertion end; the mounting chamber is provided with an insertion hole communicated to the e-liquid passing chamber; and the insertion end is arranged in the insertion hole.

Further, a third sealing ring is arranged between the insertion end and the e-liquid passing bin.

Further, each atomizing core includes: an annular shell, e-liquid absorbing cotton arranged in the annular shell, and a heating wire arranged at a bottom of the e-liquid absorbing cotton; the annular shell is provided with an e-liquid passing hole communicated to the e-liquid passing chamber; the e-liquid passing hole is formed at a position corresponding to the e-liquid passing chamber; the e-liquid absorbing cotton is annular; and the annular shell is at least partially arranged in the e-liquid passing chamber.

Further, the e-liquid passing bin includes a second top shell and a second outer shell connected to the second top shell to form the e-liquid passing chamber; a fourth scaling ring is arranged between the second top shell and the second outer shell; and a fifth sealing ring is formed between the annular shell and the second top shell.

Further, there are two atomizing cores; there are two e-liquid passing chambers, and each e-liquid passing chamber corresponds to one atomizing core; the insertion hole is located on the second top shell; the second top shell is located above the second outer shell; the mounting chamber is formed by encircling the second top shell, the annular shell, the e-liquid passing bin, and the first outer shell.

Further, the first accommodating chamber is further internally provided with a circuit board, a battery, and a microphone; the battery, the heating wire, and the microphone are all electrically connected to the circuit board; the circuit board and the battery are located below the c-liquid passing bin;

the microphone is arranged at a bottom of the first accommodating chamber; and an air inlet hole is formed in a position, corresponding to the microphone, at a bottom of the first outer shell.

Further, there are two atomizing cores, two microphones, and two air inlet holes; a through pipe is arranged at a position, corresponding to each atomizing core, in the first accommodating chamber; the two microphones are respectively located in the through pipes; a sixth sealing ring is arranged between the through pipes and the first outer shell; and a wiring hole is formed in the sixth sealing ring.

Further, a receiving slot is formed in a bottom of each e-liquid passing chamber; the annular shell at least partially passes through the e-liquid passing chamber and is placed in the receiving slot; and a via hole is formed in a bottom of the receiving slot.

Further, an adapter board electrically connected to the circuit board is arranged at a bottom of the e-liquid passing bin; the via hole also penetrates through the adapter board; the adapter board is arranged in the through pipes; a pin of the heating wire is welded on the adapter board; and an avoidance hole configured to avoid the pin of the heating wire is formed in the second outer shell.

Further, a charging port is arranged on the circuit board, and the first outer shell is provided with a jack at a position corresponding to the charging port.

Further, the first outer shell includes an intermediate shell, an inner shell, and a bottom shell; the intermediate shell sleeves an outer side of the inner shell; the first top shell and the bottom shell are respectively connected to an upper end and a lower end of the intermediate shell; the receiving slot is located on the inner shell; a top of the intermediate shell is an opening; a convex column configured to limit the e-liquid storage bins is arranged inside the intermediate shell; and the e-liquid passing bin is located in the intermediate shell.

Further, the e-liquid storage bin is in interference with a side wall of the mounting chamber.

The present disclosure has the following beneficial effects: Compared with the prior art, the present disclosure has the advantages that by the arrangement of a plurality of atomizing cores, e-liquids with different flavors can be configured on the atomizing cores to achieve different flavors to meet the needs of a user for different flavors. This solves the problem of a single flavor of the existing electronic cigarette. Furthermore, the independent e-liquid storage bins are additionally configured for the atomizing cores, which can improve the e-liquid capacity of the electronic cigarette, increase the number of times of smoking of the user, and prolong the service life of the electronic cigarette.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

The accompanying drawings in the embodiment of the present disclosure are combined, The technical scheme in the embodiment of the present disclosure is clearly and completely described, Obviously, the described embodiment is only a part of the embodiment of the present disclosure, but not all embodiments are based on the embodiment of the present disclosure, and all other embodiments obtained by ordinary technicians in the field on the premise of not doing creative work belong to the protection range of the present disclosure.

Figure 1:
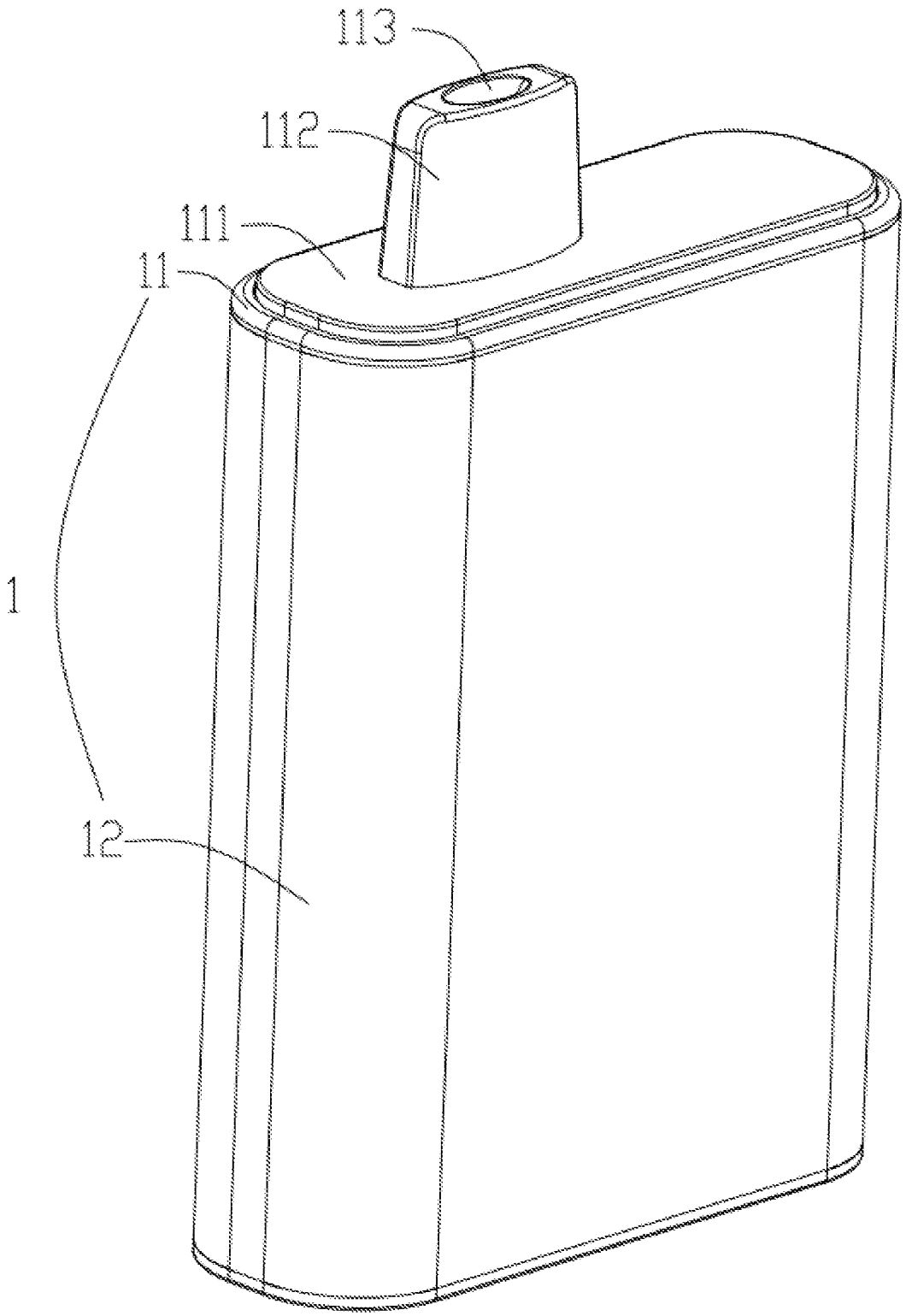
FIG. 1 is a three-dimensional diagram according to the present disclosure.
Figure 2:
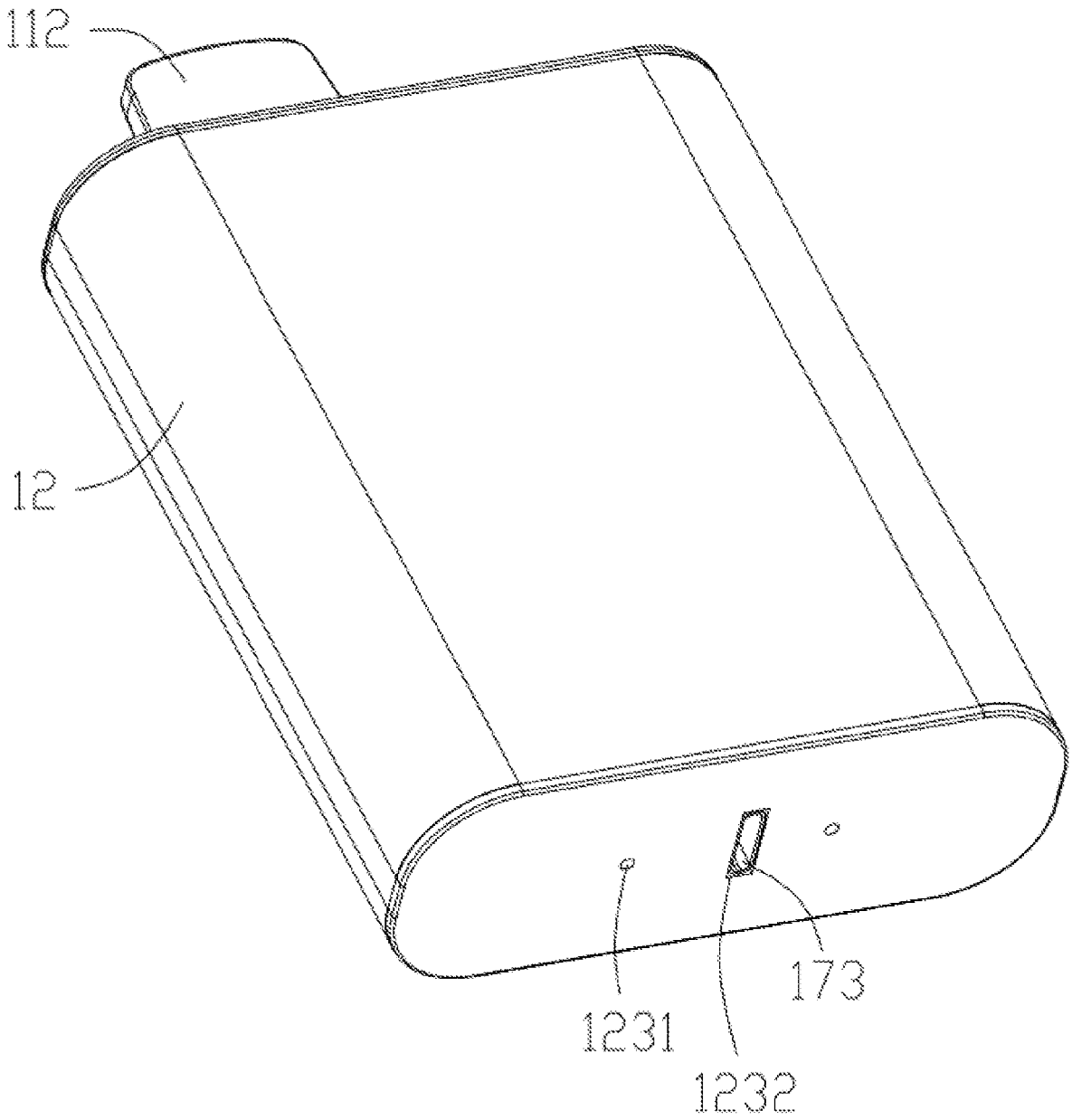
FIG. 2 is a three-dimensional diagram in another viewing angle according to the present disclosure.
Figure 3:
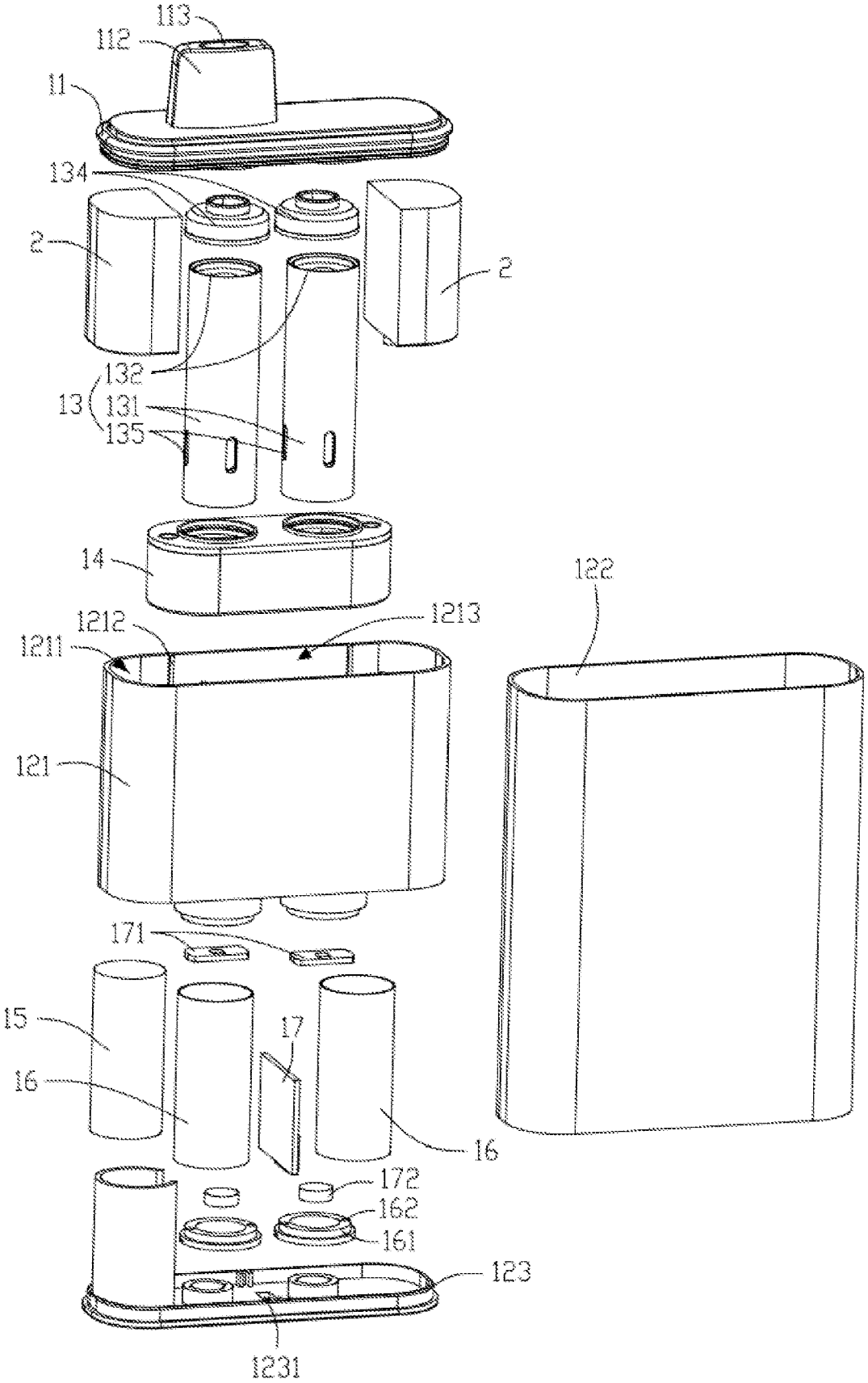
FIG. 3 is an exploded view of the present disclosure.
Figure 4:
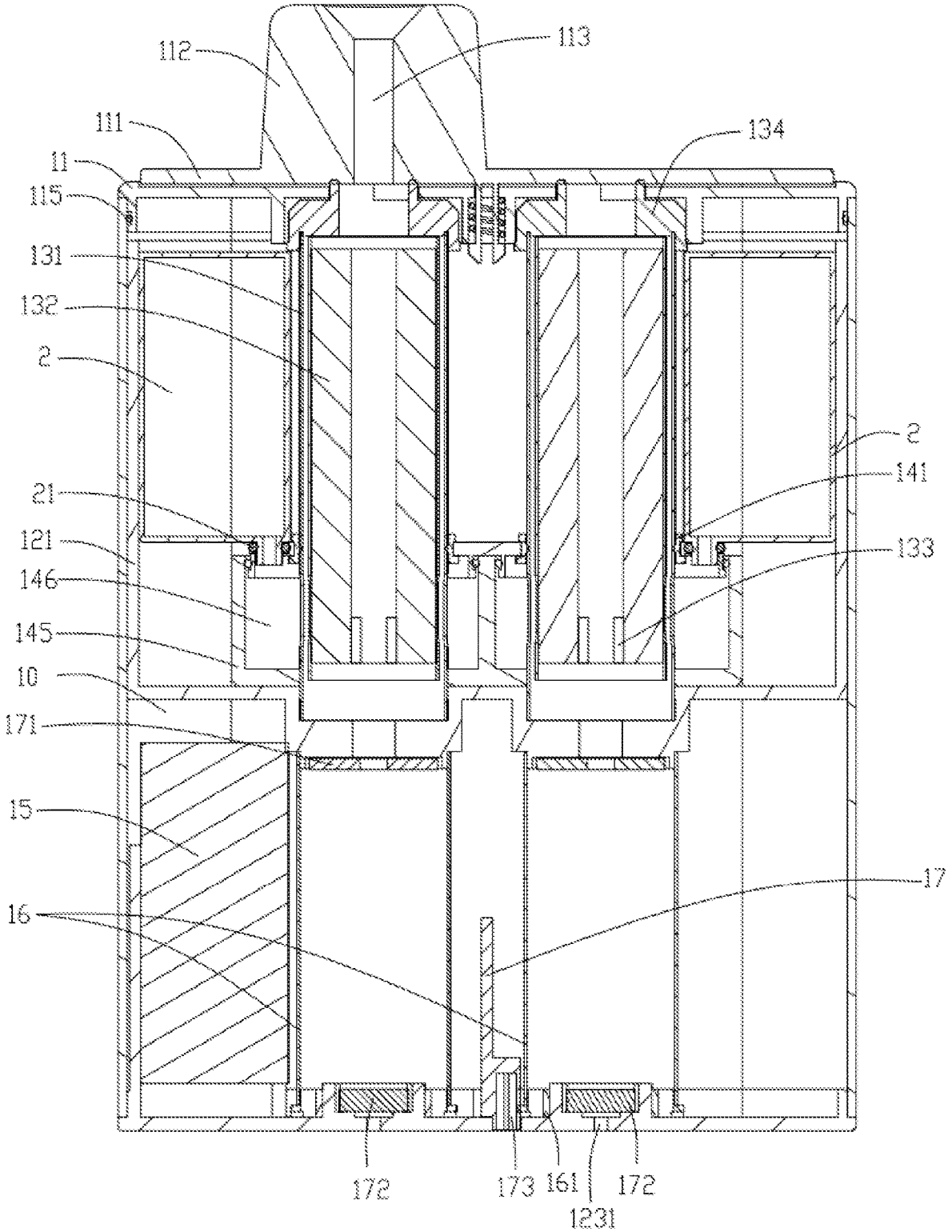
FIG. 4 is a cross-sectional view along a central line of an atomizing core according to the present disclosure.
Figure 5:
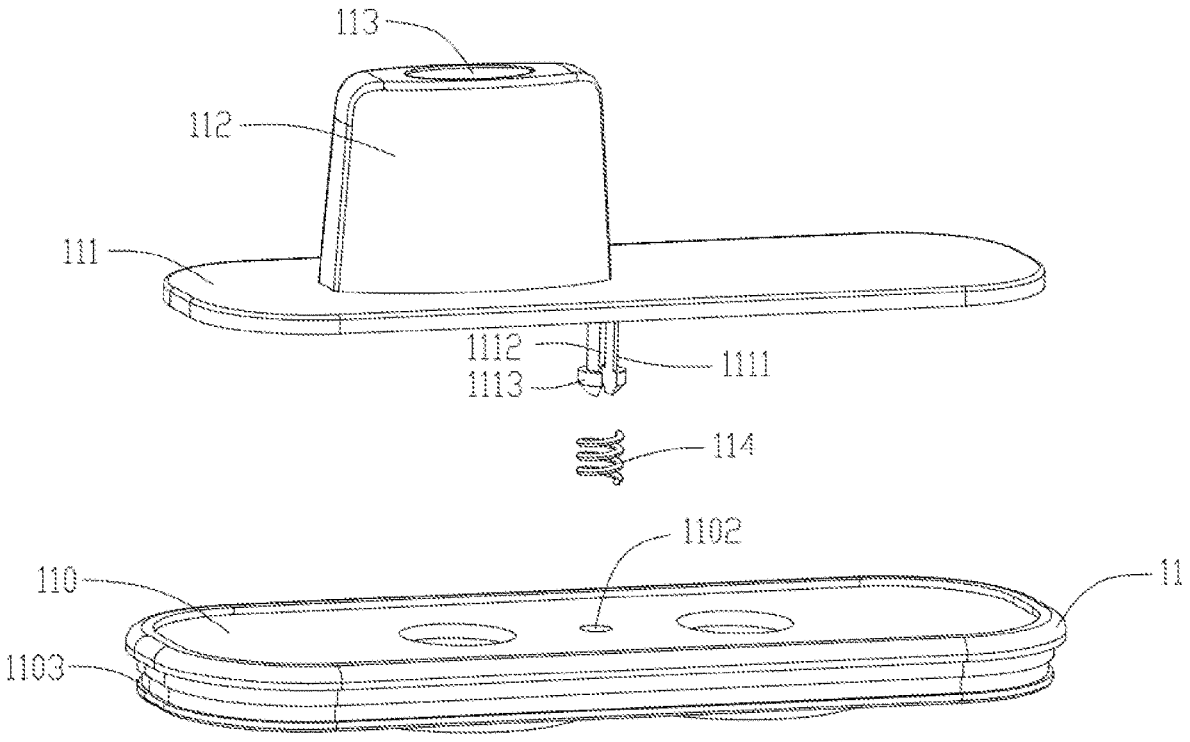
FIG. 5 is a structural diagram of a first top shell according to the present disclosure.
Figure 6:
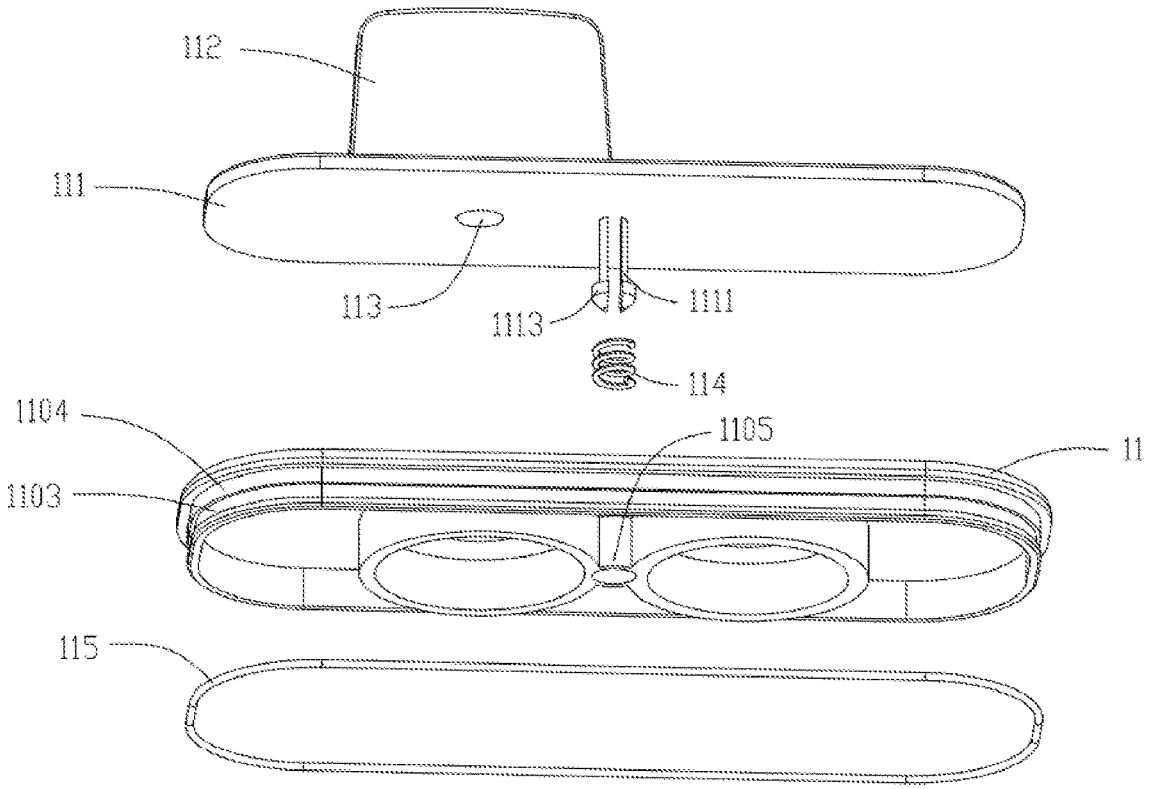
FIG. 6 is a structural diagram of a first top shell in another viewing angle according to the present disclosure.
Figure 7:
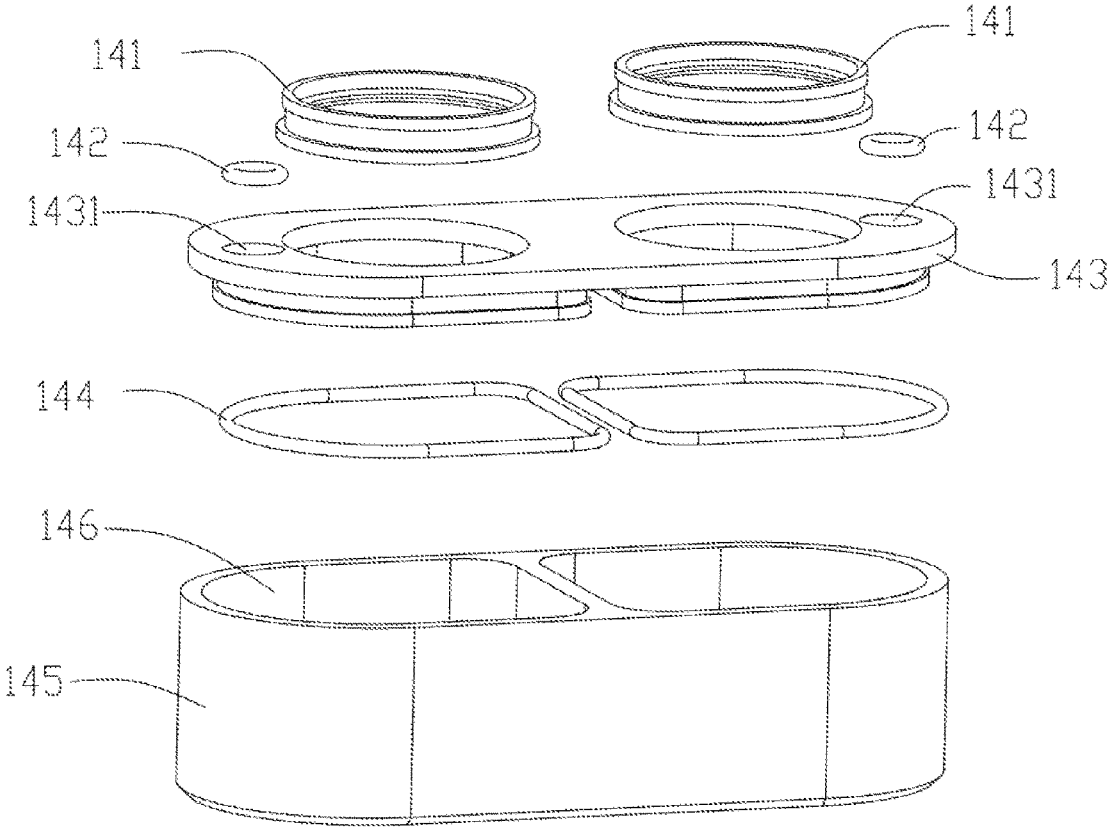
FIG. 7 is an exploded view of an e-liquid passing bin according to the present disclosure.
Figure 8:
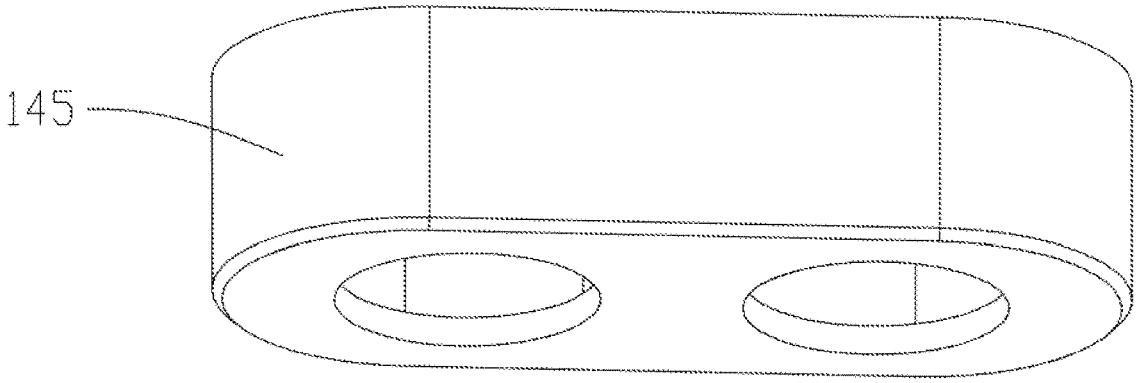
FIG. 8 is a schematic diagram of a second outer shell according to the present disclosure.
Figure 9:
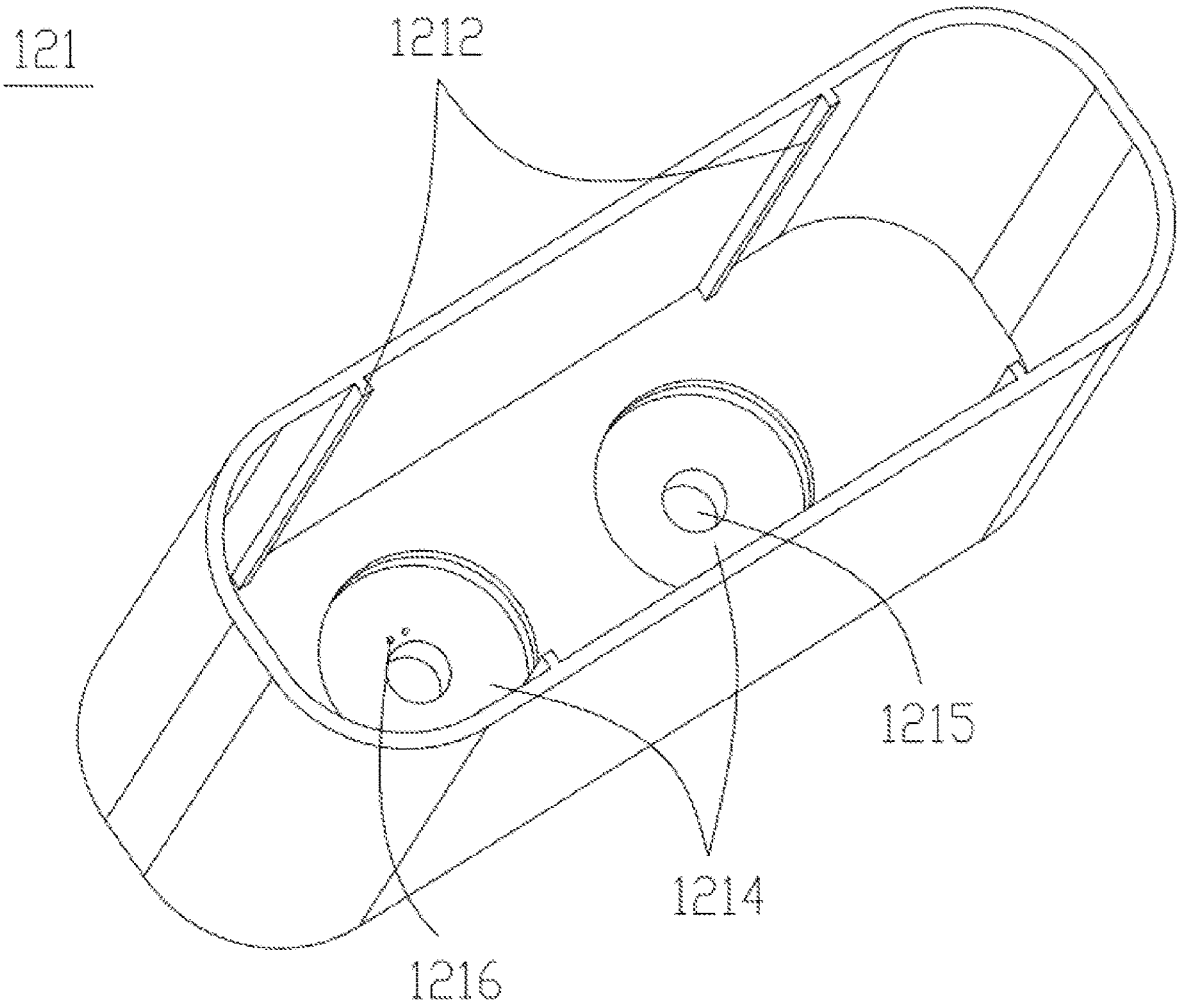
FIG. 9 is a structural diagram of an inner shell according to the present disclosure.
Figure 10:
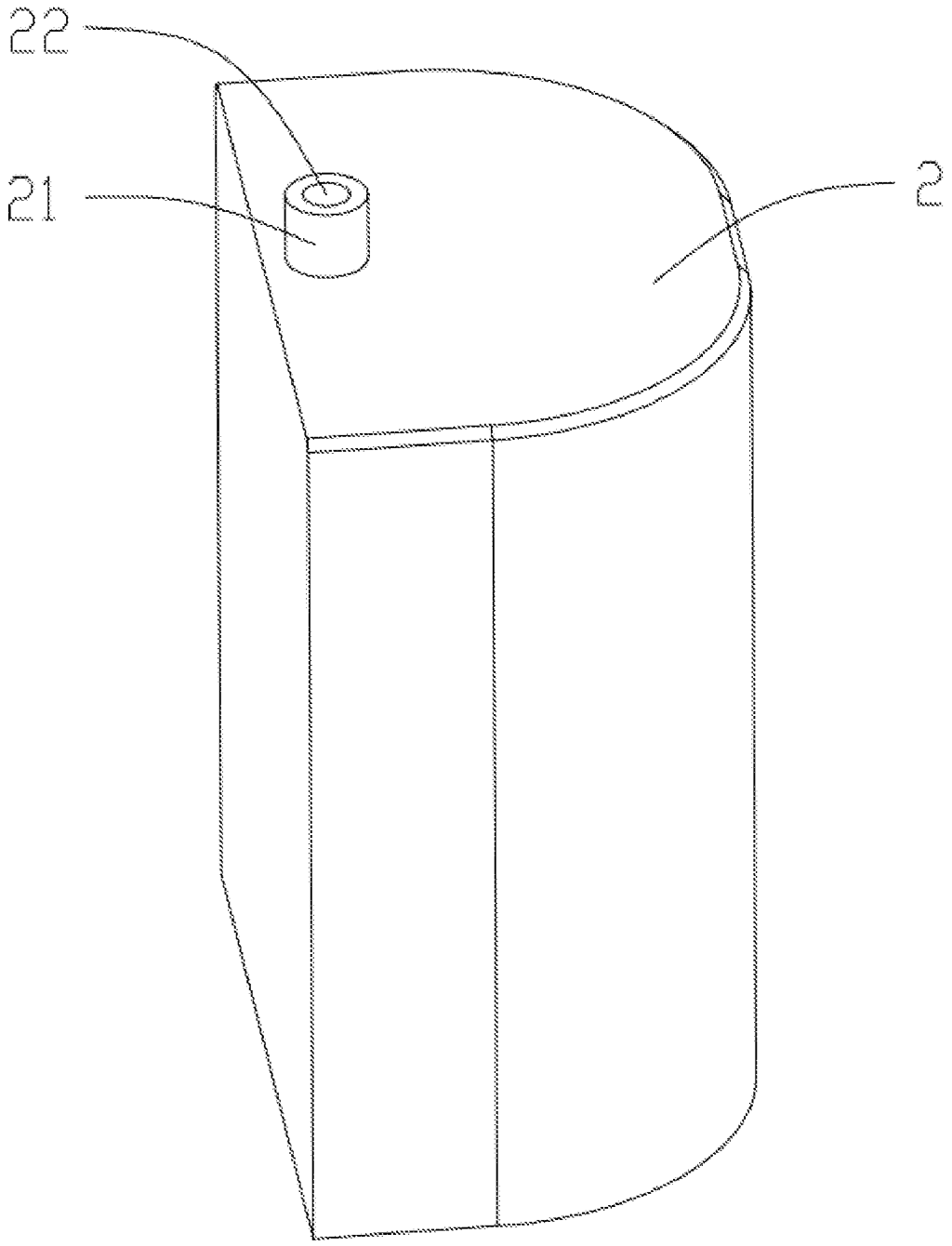
FIG. 10 is a structural diagram of an e-liquid storage bin according to the present disclosure.

Referring to FIG. 1 to FIG. 10, an electronic cigarette in the embodiments of the present disclosure is shown.

The electronic cigarette includes an electronic cigarette body 1 and a plurality of e-liquid storage bins 2 configured to store c-liquid. A plurality of atomizing cores 13 are arranged in the electronic cigarette body 1, and a mounting chamber 1211 is formed in the electronic cigarette body 1. The mounting chamber 1211 is configured to mount the e-liquid storage bins 2. An c-liquid outlet 22 configured to discharge the e-liquid is formed in each of the e-liquid storage bins 2. Each of the e-liquid storage bins 2 is at least partially arranged in the mounting chamber 1211. After the e-liquid storage bins 2 are assembled into the mounting chamber 1211, each atomizing core 13 is communicated to the e-liquid outlet 22 of at least one e-liquid storage bin 2 to add the e-liquid from the e-liquid storage bin 2 into the atomizing core 13.

In this embodiment, by the arrangement of the plurality of atomizing cores 13, c-liquids with different flavors can be configured on the atomizing cores 13 to achieve different flavors to meet the needs of a user for different flavors. This solves the problem of a single flavor of the existing electronic cigarette. Furthermore, the independent e-liquid storage bins 2 are additionally configured for the atomizing cores 13, which can improve the e-liquid capacity of the electronic cigarette, increase the number of times of smoking of the user, and prolong the service life of the electronic cigarette.

Specifically, in an embodiment, there may be two atomizing cores 13 and two e-liquid storage bins 2. Each atomizing core 13 is provided with one e-liquid storage bin 2 for use. In other embodiments, there may be two atomizing cores 13 and at least two e-liquid storage bins 2. Each atomizing core 13 is provided with at least one e-liquid storage bin 2 for use. In other embodiments, there may also be three, four, or more atomizing cores 13, and the number of the e-liquid storage bins 2 may be equal to or larger than the number of the atomizing cores 13. That is, each atomizing core 13 is provided with one e-liquid storage bin 2 for use. The number of the atomizing cores 13 and the number of the e-liquid storage bins 2 will not be limited here.

In an embodiment, each e-liquid storage bin 2 can be inserted upside down into the mounting chamber 1211. That is, when the user smokes, the e-liquid in the e-liquid storage bin 2 will flow downwards from the e-liquid outlet 22 and automatically enter the atomizing core 13 for use by the atomizing core 13. In other embodiments, each e-liquid storage bin 2 can also be inserted, from bottom to top, into the mounting chamber 1211 for mounting from a bottom of the electronic cigarette body 1. That is, the electronic cigarette needs to be placed upside down when the e-liquid in the e-liquid storage bin 2 is allowed to enter the atomizing core 13. Of course, in other embodiments, each e-liquid storage bin 2 may also be inserted into the mounting chamber 1211 from a left side, a right side, a front end, or a rear end of the atomizing core 13 or slantways. The manner of mounting the e-liquid storage bin 2 into the mounting chamber 1211 will not be limited here.

In an embodiment, in factory, the e-liquid outlet 22 can be sealed with a cover or a layer of film to prevent leakage of the e-liquid.

In an embodiment, the e-liquid storage bin 2 is non-detachable after being mounted in the mounting chamber 1211. This manner is suitable for a disposable electronic cigarette. In other embodiments, the e-liquid storage bin 2 is detachably arranged in the mounting chamber 1211, which is convenient for the user to replace the e-liquid storage bin 2.

In an embodiment, the e-liquid storage bin 2 can be partially inserted into the mounting chamber 1211, or the e-liquid storage bin 2 can be entirely embedded into the mounting chamber 1211.

In an embodiment, each e-liquid storage bin 2 can be fixed in the mounting chamber 1211 through a buckle, or each e-liquid storage bin 2 is in interference fit with a side wall of the mounting chamber 1211, so as to mount the e-liquid storage bin 2 in the mounting chamber 1211 and prevent the e-liquid storage bin 2 from falling out of the mounting chamber 1211 without an external force.

In an embodiment, the electronic cigarette body 1 includes a first top shell 11 and a first outer shell 12 connected to the first top shell 11 to form a first accommodating chamber 10. The atomizing cores 13 and the mounting chamber 1211 are both located in the first accommodating chamber 10. The first top shell 11 is detachably connected to the first outer shell 12, so that when the first top shell 11 is removed, the e-liquid storage bins 2 can be mounted in the mounting chamber 1211.

Specifically, a bottom of the first top shell 11 extends downwards from a position close to a peripheral side of the first top shell to form a first enclosure wall 1104. The first enclosure wall 1104 is arranged in the first accommodating chamber 10 when the first top shell 11 is connected to the first outer shell 12; and a first sealing ring 115 is arranged between the first enclosure wall 1104 and a side wall of the first accommodating chamber 10. The first top shell 11 is fixed on the first outer shell 12 using the first sealing ring 115.

In an embodiment, a first groove 1103 is formed in the first enclosure wall 1104, and the first sealing ring 115 is partially arranged in the first groove 1103. The first groove 1103 can be used to limit the first sealing ring 115, so as to prevent the problem that the first sealing ring 115 falls off during the removal of the first top shell 11. Of course, in other embodiments, the first top shell 11 can also be detachably connected to the first outer shell 12 through a buckle, a thread, and the like.

Specifically, in the above embodiments, a mouthpiece 112 is arranged on the first top shell 11, and a smoke outlet 113 communicated to the atomizing cores 13 is formed in the mouthpiece 112. A second sealing ring 134 is arranged between the atomizing cores 13 and the first top shell 11, and the mouthpiece 112 is used by the user. The second sealing ring 134 is used to achieve sealing between the atomizing cores 13 and the first top shell 11, so that after the atomizing cores 13 atomize the e-liquid, the formed smoke will not overflow from a gap 1112 between the atomizing cores 13 and the first top shell 11.

In an embodiment, there are two atomizing cores 13 which are arranged side by side in a width direction of the electronic cigarette body 1; and there is one mouthpiece 112. A bottom of the mouthpiece 112 extends outwards to form a panel 111; the panel 111 is rotatably arranged on the first top shell 11; and the smoke outlet 113 is communicated to the other atomizing core 13 when the panel 111 rotates at a predetermined angle relative to the first top shell 11. In this way, when the user needs to use the other atomizing core 13, the user can perform switching between the atomizing cores 13 by rotating the panel 111, which facilitates use, so as to prevent the influence on use by the user due to multiple mouthpieces 112 and a short distance.

In an embodiment, the panel 111 extends downwards to form a limiting column 1111; a bottom of the limiting column 1111 extends outwards to form a limiting block 1113; a gap 1112 penetrating through the limiting column is formed in the limiting column 1111. The first top shell 11 is provided with a connection hole 1102 between two atomizing cores 13; the limiting column 1111 is arranged inside the connection hole 1102; and an elastic member 114 is arranged between the limiting block 1113 and the first top shell 11. By the use of the gap 1112, the limiting column 1111 can be divided into two parts, and the limiting block 1113 can pass through the connection hole 1102. The limiting block 1113 cooperates with the elastic member 114 to enable the panel 111 to resist against a surface of the first top shell 11. After the panel 111 is pulled upwards, the clastic member 114 is compressed, which can achieve rotatable connection between the panel 111 and the first top shell 11. Specifically, the clastic member 114 is preferably a spring, and the spring sleeves the limiting column 1111. Of course, in other embodiments, the elastic member 114 may also be an elastic sheet.

In an embodiment, a second groove 110 is formed in an upper surface of the first top shell 11, and the panel 111 is arranged in the second groove 110 to limit the panel 111 and prevent the panel 111 from rotating without an operation performed by the user.

In an embodiment, the first top shell 11 extends downwards from a peripheral side of the connection hole 1102 to form a second enclosure wall 1105; and the clastic member 114 is arranged in the second enclosure wall 1105, so as to improve the stability of mounting of the clastic member 114.

In an embodiment, the electronic cigarette body 1 is internally provided with an e-liquid passing bin 14; and at least one e-liquid passing chamber 146 communicated to the atomizing cores 13 is formed in the e-liquid passing bin 14. One end of each of the e-liquid storage bins 2 is provided with an insertion end 21, and the e-liquid outlet 22 penetrates through the insertion end 21; the e-liquid passing bin 14 is provided with an insertion hole 1431 communicated to the e-liquid passing chamber 146; and the insertion end 21 is arranged in the insertion hole 1431. A third sealing ring 142 is arranged between the insertion end 21 and the e-liquid passing bin 14. By the use of the e-liquid passing bin 14 for transition, the e-liquid of each e-liquid storage bin 2 enters each atomizing core 13 after passing through the e-liquid passing chamber 146, facilitating the production and manufacturing of the electronic cigarette in this embodiment. Furthermore, by the use of the third sealing ring 142, leakage of the e-liquid can be prevented, and an effect of limiting the e-liquid storage bin 2 can also be achieved.

In an embodiment, a projection of a side surface of the third sealing ring 142 is I-shaped. A scaling protrusion configured to resist against an outer side wall of the insertion end 21 is convexly formed on an inner side wall of the third scaling ring 142, so that when the insertion end 21 is inserted into the insertion hole 1431, the problem that the third sealing ring 142 falls off is prevented. Moreover, the scaling protrusion can effectively play a sealing role.

In the above embodiment, each atomizing core 13 includes: an annular shell 131, e-liquid absorbing cotton 132 arranged in the annular shell 131, and a heating wire 133 arranged at a bottom end of the e-liquid absorbing cotton 132. An e-liquid passing hole 135 communicated to the e-liquid passing chamber 146 is formed in the annular shell 131. The e-liquid passing hole 135 is formed at a position corresponding to the e-liquid passing chamber 146. The e-liquid absorbing cotton 132 is annular; and the annular shell 131 is at least partially arranged in the c-liquid passing chamber 146. By the use of the e-liquid absorbing cotton 132 to adsorb the c-liquid, the e-liquid in the atomizing cores 13 can be prevented from leaking out of the atomizing cores 13 when the e-liquid storage bins 2 are not mounted. Moreover, under its own gravity, the e-liquid will be converged towards the bottom of the e-liquid absorbing cotton 132, so that when the heating wire 133 performs heating, the e-liquid can be atomized.

In practical applications, the e-liquid absorbing capacity of the e-liquid absorbing cotton 132 and the capacity of storing the e-liquid in the e-liquid storage bins 2 can be customized and limited by manufacturers. For example, when the electronic cigarette of this embodiment leaves the factory, the e-liquid absorbing cotton 132 can adsorb 2 ml of e-liquid, and each e-liquid storage bin 2 can store 10 ml of e-liquid. Or, in other embodiments, the e-liquid absorbing cotton 132 can adsorb 1.8 ml of e-liquid, and each e-liquid storage bin 2 can store 15 ml of e-liquid.

In an embodiment, the e-liquid passing bin 14 includes a second top shell 143 and a second outer shell 145 connected to the second top shell 143 to form an e-liquid passing chamber 146; a fourth sealing ring 144 is arranged between the second top shell 143 and the second outer shell 145; and a fifth sealing ring 141 is formed between the annular shell 131 and the second top shell 143 to form a sealed e-liquid passing chamber 146 to prevent leakage of the e-liquid.

In an embodiment, there are two atomizing cores 13. There are two e-liquid passing chambers 146 that are not communicated to each other, each of which corresponds to one atomizing core 13. That is, it should be understood that there are two e-liquid passing chambers 146 formed in the e-liquid passing bin 14. Or, one electronic cigarette body 1 has two c-liquid passing bins 14 to be used in conjunction with two atomizing cores 13. Specifically, the insertion hole 1431 is located on the second top shell 143, and the second top shell 143 is located above the second outer shell 145. The mounting chamber 1211 is formed by encircling the second top shell 143, the annular shell 131, the e-liquid passing bin 14, and the first outer shell 12.

In the above embodiment, the first accommodating chamber 10 is further internally provided with a circuit board 17, a battery 15, and a microphone 172; the battery 15, the heating wire 133, and the microphone 172 are all electrically connected to the circuit board 17; and the circuit board 17 and the battery 15 are located below the e-liquid passing bin 14. The microphone 172 is arranged at a bottom of the first accommodating chamber 10; and an air inlet hole 1231 is formed in a position, corresponding to the microphone 172, at a bottom of the first outer shell 12. When the user smokes, air enters the electronic cigarette through the air inlet hole 1231. The microphone 172 feeds back an electrical signal to the circuit board 17 when detecting an air pressure difference. The circuit board 17 drives the heating wire 133 to generate heat according to the electrical signal, so as to atomize the e-liquid and discharge smoke from the mouthpiece 112.

In an embodiment, there are two atomizing cores 13, two microphones 172, and two air inlet holes 1231. A through pipe 16 is arranged at a position, corresponding to each atomizing core 13, in the first accommodating chamber 10; the two microphones 172 are respectively located in the through pipes 16; a sixth sealing ring 161 is arranged between the through pipes 16 and the first outer shell 12; and a wiring hole 162 is formed in the sixth sealing ring 161, so that each atomizing core 13 is used in conjunction with one microphone 172. Therefore, when the user inhales through the mouthpiece 112, the circuit board 17 controls the corresponding atomizing core 13 to work according to the electrical signal fed back by each microphone 172, so as to prevent the two atomizing cores 13 to work simultaneously.

In an embodiment, a receiving slot 1214 is formed in a bottom of each e-liquid passing chamber 146; the annular shell 131 at least partially passes through the e-liquid passing chamber 146 and is placed in the receiving slot 1214, so as to limit the atomizing core 13. A top of each through pipe 16 sleeves an outer side wall of the receiving slot 1214, and a via bole 1215 is formed in a bottom of the receiving slot 1214 to communicate the receiving slot 1214 to the through pipe 16.

In an embodiment, an adapter board 171 electrically connected to the circuit board 17 is arranged at a bottom of the e-liquid passing bin 14; the via hole 1215 also penetrates through the adapter board 171; the adapter board 171 is arranged in the through pipes 16; a pin of the heating wire 133 is welded on the adapter board 171, so as to fix the heating wire 133; and an avoidance hole 1216 configured to avoid the pin of the heating wire 133 is formed in the second outer shell 145. Furthermore, the adapter board 171 can achieve electrical connection between the heating wire 133 and the circuit board 17.

In an embodiment, a charging port 173 is arranged on the circuit board 17, and the first outer shell 12 is provided with a jack 1232 at a position corresponding to the charging port 173. The charging port 173 is connected to a power supply, and the battery 15 can be charged via the circuit board 17. Specifically, the charging port 173 can be a USB-C interface, a USB-A interface, and the like.

In an embodiment, in order to facilitate the production and manufacturing of the first outer shell 12, the first outer shell 12 includes an intermediate shell 122, an inner shell 121, and a bottom shell 123. The intermediate shell 122 sleeves an outer side of the inner shell 121; and the first top shell 11 and the bottom shell 123 are respectively connected to an upper end and a lower end of the intermediate shell 122. The receiving slot 1214 is located on the inner shell 121; a top of the intermediate shell 122 is an opening 1213; a convex column 1212 configured to limit the e-liquid storage bins 2 is arranged inside the intermediate shell 122; the mounting chamber is composed of the convex column 1212, the intermediate shell 122, and the e-liquid passing bin 14; and the e-liquid passing bin 14 is located in the intermediate shell 122. By the use of the intermediate shell 122, the intensity of the first outer shell 12 can be improved.

It should be noted that all directional indications (such as up, down, left, right, front, back . . . ) in the embodiments of the present disclosure are only used to explain a relative positional relationship between components, motion situations, etc. at a certain specific attitude (as shown in the figures). If the specific attitude changes, the directional indication also correspondingly changes.

In addition, the descriptions of "first", "second", etc. in the present disclosure are only used for descriptive purposes, and cannot be understood as indicating or implying its relative importance or implicitly indicating the number of technical features indicated. Therefore, features defined by "first" and "second" can explicitly instruct or impliedly include at least one feature. In addition, "and/or" in the entire text includes three solutions. A and/or B is taken as an example, including technical solution A, technical solution B, and technical solutions that both A and B satisfy. In addition, the technical solutions between the various embodiments can be combined with each other, but it needs be based on what can be achieved by those of ordinary skill in the art. When the combination of the technical solutions is contradictory or cannot be achieved, it should be considered that such a combination of the technical solutions does not exist, and is not within the scope of protection claimed by the present disclosure.

The above descriptions are only preferred embodiments of the present disclosure, and are not intended to limit the patent scope of the present disclosure. Any equivalent structural transformation made by using the content of the specification and the drawings of the present disclosure under the invention idea of the present disclosure, directly or indirectly applied to other related technical fields, shall all be included in the scope of patent protection of the present disclosure.

What is claimed is:

1. An electronic cigarette, comprising an electronic cigarette body and a plurality of e-liquid storage bins configured to store e-liquid, wherein the electronic cigarette body is provided with a plurality of atomizing cores, and a mounting chamber is arranged on the electronic cigarette body;

the mounting chamber is configured to mount the e-liquid storage bins; an e-liquid outlet configured to discharge the e-liquid is formed in each of the e-liquid storage bins; each of the e-liquid storage bins is at least partially arranged in the mounting chamber; and after the e-liquid storage bins are assembled into the mounting chamber, each of the atomizing cores is communicated to the e-liquid outlet of at least one e-liquid storage bin to add the e-liquid from the e-liquid storage bin into the atomizing core, wherein the electronic cigarette body comprises a first top shell and a first outer shell connected to the first top shell to form a first accommodating chamber; the first top shell is detachably connected to the first outer shell; and the atomizing cores and the mounting chamber are both located in the first accommodating chamber.

2. The electronic cigarette according to claim 1, wherein a bottom of the first top shell extends downwards from a position close to a peripheral side of the first top shell to form a first enclosure wall;

the first enclosure wall is arranged in the first accommodating chamber when the first top shell is connected to the first outer shell; and a first sealing ring is arranged between the first enclosure wall and a side wall of the first accommodating chamber.

3. The electronic cigarette according to claim 2, wherein a first groove is formed in the first enclosure wall, and the first sealing ring is partially arranged inside the first groove;

a mouthpiece is arranged on the first top shell; a smoke outlet communicated to an atomizing core is formed in the mouthpiece; and a second sealing ring is arranged between the atomizing core and the first top shell.

4. The electronic cigarette according to claim 3, wherein there are two atomizing cores which are arranged side by side in a width direction of the electronic cigarette body; there is one mouthpiece;

a bottom of the mouthpiece extends outwards to form a panel; the panel is rotatably arranged on the first top shell; and the smoke outlet is communicated to the other atomizing core when the panel rotates at a predetermined angle relative to the first top shell.

5. The electronic cigarette according to claim 4, wherein the panel extends downwards to form a limiting column; a bottom of the limiting column extends outwards to form a limiting block; a gap penetrating through the limiting column is formed in the limiting column;

the first top shell is provided with a connection hole between two atomizing cores; the limiting column is arranged inside the connection hole; and an elastic member is arranged between the limiting block and the first top shell.

6. The electronic cigarette according to claim 5, wherein the elastic member is a spring, and the spring sleeves the limiting column;

a second groove is formed in an upper surface of the first top shell; and the panel is arranged inside the second groove.

7. The electronic cigarette according to claim 6, wherein the first top shell extends downwards from a peripheral side of the connection hole to form a second enclosure wall; and the elastic member is arranged in the second enclosure wall.

8. He electronic cigarette according to claim 1, wherein the electronic cigarette body is internally provided with an e-liquid passing bin; at least one e-liquid passing chamber communicated to the atomizing cores is formed in the e-liquid passing bin;

one end of each of the e-liquid storage bins is provided with an insertion end, and the e-liquid outlet penetrates through the insertion end; the e-liquid storage bin is provided with an insertion hole communicated to the e-liquid passing chamber; and the insertion end is arranged in the insertion hole.

9. The electronic cigarette according to claim 8, wherein a third sealing ring is arranged between the insertion end and the e-liquid passing bin.

10. The electronic cigarette according to claim 8, wherein each atomizing core comprises: an annular shell, e-liquid absorbing cotton arranged in the annular shell, and a heating wire arranged at a bottom of the e-liquid absorbing cotton; the annular shell is provided with an e-liquid passing hole communicated to the e-liquid passing chamber; the e-liquid passing hole is formed at a position corresponding to the e-liquid passing chamber; the e-liquid absorbing cotton is annular; and the annular shell is at least partially arranged in the e-liquid passing chamber.

11. The electronic cigarette according to claim 10, wherein the e-liquid passing bin comprises a second top shell and a second outer shell connected to the second top shell to form the e-liquid passing chamber; a fourth sealing ring is arranged between the second top shell and the second outer shell; and a fifth sealing ring is formed between the annular shell and the second top shell.

12. The electronic cigarette according to claim 11, wherein there are two atomizing cores; there are two e-liquid passing chambers, and each e-liquid passing chamber corresponds to one atomizing core; the insertion hole is located on the second top shell; the second top shell is located above the second outer shell; the mounting chamber is formed by encircling the second top shell, the annular shell, the e-liquid passing bin, and the first outer shell.

13. The electronic cigarette according to claim 11, wherein the first accommodating chamber is further internally provided with a circuit board, a battery, and a microphone; the battery, the heating wire, and the microphone are all electrically connected to the circuit board; the circuit board and the battery are located below the e-liquid passing bin;

the microphone is arranged at a bottom of the first accommodating chamber; and an air inlet hole is formed in a position, corresponding to the microphone, at a bottom of the first outer shell.

14. The electronic cigarette according to claim 13, wherein there are two atomizing cores, two microphones, and two air inlet holes; a through pipe is arranged at a position, corresponding to each atomizing core, in the first accommodating chamber; the two microphones are respectively located in the through pipes; a sixth sealing ring is arranged between the through pipes and the first outer shell; and a wiring hole is formed in the sixth sealing ring.

15. The electronic cigarette according to claim 14, wherein a receiving slot is formed in a bottom of each e-liquid passing chamber; the annular shell at least partially passes through the e-liquid passing chamber and is placed in the receiving slot; and a via hole is formed in a bottom of the receiving slot.

16. The electronic cigarette according to claim 15, wherein an adapter board electrically connected to the circuit board is arranged at a bottom of the e-liquid passing bin; the via hole also penetrates through the adapter board; the adapter board is arranged in the through pipes; a pin of the heating wire is welded on the adapter board; and an avoidance hole configured to avoid the pin of the heating wire is formed in the second outer shell.

17. The electronic cigarette according to claim 16, wherein a charging port is arranged on the circuit board, and the first outer shell is provided with a jack at a position corresponding to the charging port.

18. The electronic cigarette according to claim 16, wherein the first outer shell comprises an intermediate shell, an inner shell, and a bottom shell; the intermediate shell sleeves an outer side of the inner shell; the first top shell and the bottom shell are respectively connected to an upper end and a lower end of the intermediate shell; the receiving slot is located on the inner shell; a top of the intermediate shell is an opening; a convex column configured to limit the e-liquid storage bins is arranged inside the intermediate shell; and the e-liquid passing bin is located in the intermediate shell.

19. The electronic cigarette according to claim 18, wherein the e-liquid storage bin is in interference with a side wall of the mounting chamber.

* * * * *